United States Patent [19]

Foster et al.

[11] Patent Number: 4,985,946

[45] Date of Patent: Jan. 22, 1991

[54] HOSPITAL BED ADAPTED FOR USE WITH A C-ARM

[75] Inventors: L. Dale Foster, Brookville; David W. Hornbach, Guilford, both of Ind.

[73] Assignee: Hill-Rom Company, Inc., Batesville, Ind.

[21] Appl. No.: 386,210

[22] Filed: Jul. 28, 1989

[51] Int. Cl.[5] ..... A61G 7/00; A47C 21/08

[52] U.S. Cl. ..... 5/60; 5/430; 5/427; 5/86

[58] Field of Search ..... 5/60, 66, 181, 185, 5/425, 427, 428, 430, 86, 81 R, 81 B; 296/20

[56] References Cited

U.S. PATENT DOCUMENTS

| | | | |
|---|---|---|---|
| 2,284,470 | 5/1942 | Comper | 5/66 |
| 2,786,214 | 3/1957 | Armstrong | 5/430 |
| 3,585,660 | 6/1971 | Gottfried | 5/430 |
| 3,930,273 | 1/1976 | Stern | 5/430 |
| 3,958,283 | 5/1976 | Adams | 5/66 |
| 4,002,330 | 1/1977 | Johansson | 5/428 |
| 4,206,525 | 6/1980 | Williams | 5/430 |
| 4,486,908 | 12/1984 | Schroeder | 5/60 |
| 4,669,136 | 6/1987 | Waters | 5/181 |
| 4,747,171 | 5/1988 | Einsele | 5/430 |

FOREIGN PATENT DOCUMENTS

| | | | |
|---|---|---|---|
| 189572 | 12/1922 | United Kingdom | 5/185 |

*Primary Examiner*—Eric K. Nicholson
*Assistant Examiner*—F. Saether
*Attorney, Agent, or Firm*—Wood, Herron & Evans

[57] ABSTRACT

A hospital bed is supported on a Y-shaped base to facilitate the introduction of a C-arm for imaging a patient's chest. Head guards are mounted on each side of the head end of the bed on linkages that permit the head guards to be swung toward the foot end of the bed to improve the positioning of the C-arm over the head end of the bed. The head panel has pivotable longitudinal edges to further improve the positioning of the C-arm over the head end of the bed. Pivotable longitudinal edges of the head and leg panels permit head and foot guards to be moved laterally inwardly to narrow the bed for transporting a patient.

12 Claims, 10 Drawing Sheets

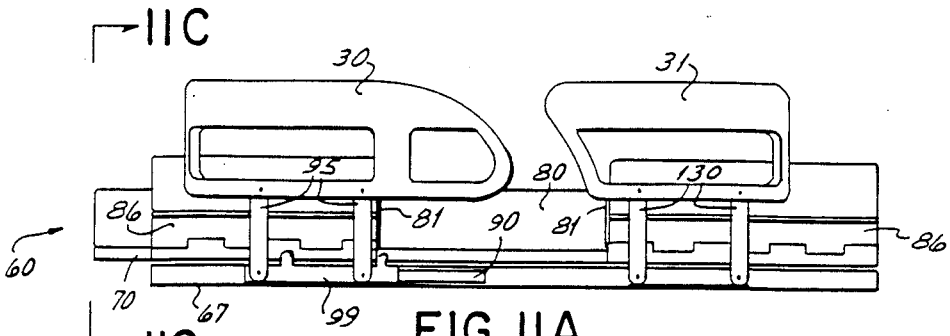
FIG. IIA
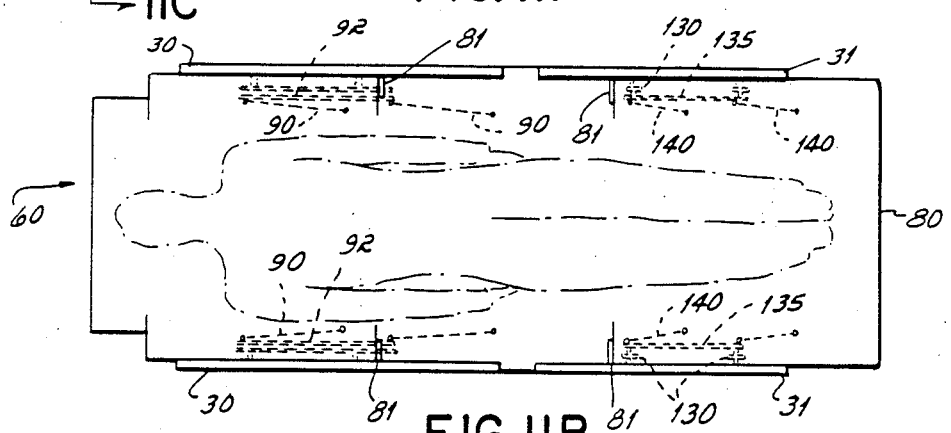
FIG. IIB
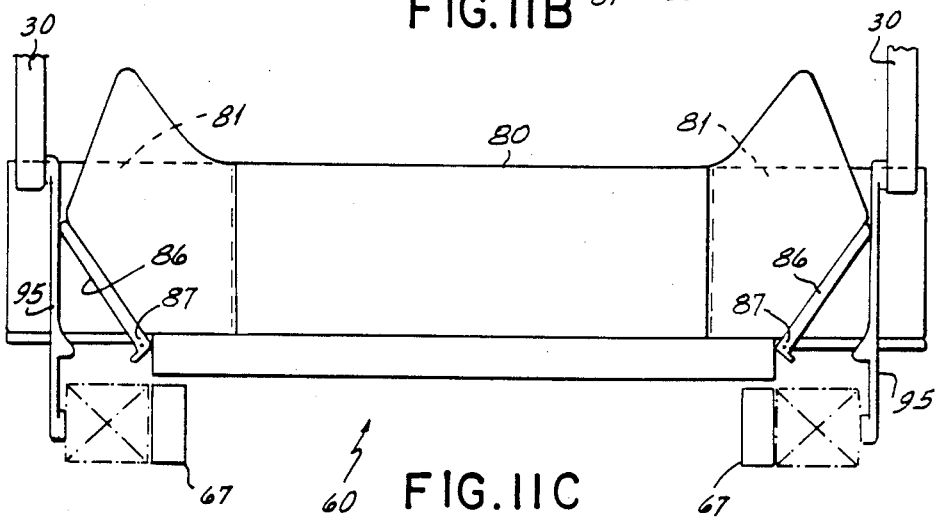
FIG. IIC

HOSPITAL BED ADAPTED FOR USE WITH A C-ARM

BACKGROUND OF THE INVENTION

This invention relates to a critical care hospital bed that is especially adapted to be used with a mobile radiographic/fluoroscopic unit which is usually referred to as a C-arm or C-arm unit.

A C-arm is a real time fluroroscope used to provide images of a patient's chest area. The apparatus has an arm that is shaped like a C and has an X-ray tube at the upper free end and a receiver image intensifier at the lower end. The C-arm is supported at the end of a cantilever beam which in turn is supported on a mobile base. The C-arm is rolled to a patient's critical care room and is slid around the patient's bed with the receiver underneath the patient and the X-ray tube over the patient. With the C-arm in place and a monitor available for the cardiologist's viewing, the cardiologist can observe, in real time, the movement of surgical devices that are inserted into the patient's heart from various branches of the patient's cardiovascular system.

The invention described herein relates to an improvement in the critical care bed that is used with the C-arm to provide the capability of obtaining images of the patient's chest area over a greater area than has been possible heretofore.

A state of the art critical care bed is disclosed in U.S. Pat. No. 4,751,754. The bed of that patent has, as its base, an elongated central backbone supported on bars at each end, the bars having casters at their ends. A two-bar cantilever support for the bed is mounted at its lower end to one end of the backbone. It is inclined upwardly and is mounted at its upper end to a bracket located at about the center of the bed. The cantilevered support opens up one end of the bed—in this case the head end of the bed—for the insertion of the lower end of the C-arm.

The bed has a rectangular bed frame and overlying it a patient support consisting of four rectangular frames that are pivoted together to enable adjustment of the position of the patient on the bed. The four rectangular frame members define and support a head panel, a seat panel, a thigh panel and a leg panel. The head panel has a translucent center portion which is about 18×30 inches in dimensions. Surrounding the translucent portion are opaque support elements projecting laterally outward from the 18 inch translucent center of the head panel, thus creating the normal bed width of 34 inches. Alongside the head and leg panels are head guards and foot guards that project above the mattress on each side of the bed to keep the patient from inadvertently sliding out of the bed.

The bed and guards limit the movement of the C-arm over the bed and as a result, the beam from X-ray tube to receiver cannot be moved to the center of the complete translucent area of the head panel. As a consequence, it is necessary to shift the patient before or during a procedure to one side of the bed so that the invasive surgical implement can be viewed as it passes through arteries into the patient's heart. The C-arm is obstructed by the head guard that is mounted alongside the head panel. The C-arm would also be obstructed by engagement with the side edge of the bed even if the head guard is removed.

The lower end or receiver portion of the C-arm is further obstructed by the backbone's extending down the center of the base below the bed. The upper surface of the backbone is about 8 inches off the floor. The receiver for the C-arm projects downwardly from the end of the C-arm. Somehow the receiver must clear the backbone in order for the receiver to pass over to the center of the bed. In practice, the bed has been raised by swinging the cantilever support upwardly until there can be clearance between the lower end of the C-arm and the backbone as the C-arm is brought into position over the patient. The raising of the bed means that the patient is going to be at an uncomfortable level for the cardiologist so that the cardiologist may even be required to stand on a stool in order to perform the surgical procedures that are monitored by the C-arm.

SUMMARY OF THE INVENTION

An objective of the invention has been to provide a critical bed structure that is more suited to receive and properly position a C-arm over substantially the entire window or translucent area of the head panel.

Another objective of the invention has been to provide for narrowing the bed, with head and foot guards in place, so that the bed, with patient aboard, can be easily moved through doorways to transport the patient from place to place.

As a first feature of the invention, the base is modified to the form of a Y structure having a stem at the foot end of the bed and laterally spread branches at the head end of the bed. The laterally spread branches open up the area under the head panel. Hence, the C-arm can be brought into the opening created by the laterally spread branches and into position under the patient and the translucent head panel. By providing for the introduction of the C-arm receiver into the space between the branches of the Y, the bed does not have to be raised in order to enable the lower portion of the C-arm to clear the backbone of the bed. Thus, the height of the bed during the surgical procedure can be reduced by about 6 inches or so.

As another improved feature of the bed, the invention provides for the mounting of the head guard on swinging arms which permit the head guard to be swung from its normal position alongside the head panel to a position toward the foot end of the bed, thereby clearing out the side of the bed containing the head panel for movement of the C-arm into position. A foot guard is normally fixedly mounted on the bed toward the foot end of the bed. The head guard is configurated to nest with the foot guard when it has been swung to its inoperative position opening up the head panel.

The head guard assembly is mounted on the same pivot axis as is the head panel so that when the head panel is raised to raise the patient to a sitting position, the head guard is also raised with it. The head guard has a surface, adjacent the foot guard, that has a radius with its center on the pivot axis of the head panel so that it can be positioned close to the foot guard, thereby enabling the gap between the guards to be kept as narrow as possible.

As another feature of the bed, the head panel is formed of a narrow frame whose internal dimensions define the translucent window. It overlies the bed frame. Since its lateral dimension is only about 22 inches, it is not sufficiently wide to support a patient. A translucent head panel is snapped into position on the head frame and a mattress covers the translucent panel. Alongside the assembly of patient support frame, translucent panel and mattress is a longitudinal section which has a mattress-like covering on its upper surface. When in normal position on each side of the head panel, it provides a patient support of standard width of about 34 inches. The longitudinal section, however, is removable as by pivoting it upwardly with respect to the head panel, or by physically removing it and placing it at the head end of the bed. The removal of the insert from the side of the head panel reduces further the obstruction to the C-arm, thereby permitting its X-ray beam to cover substantially the entire area of the translucent panel at the head end of the bed.

The space vacated by the upward pivoting of the longitudinal head panel sections on both sides of the bed permits inward shifting of the head guards to narrow the head of the bed with head guards in protective position. Comparable structure at the foot of the bed permits inward shifting of the foot guards, thereby creating an overall narrowing of the bed with the guards keeping the patient protected. In this condition, the bed can be rolled through narrow doorways for transporting the patient to other areas of the hospital.

To summarize, there are four primary positions of the head guard that are contemplated by the present invention. The first position, a conventional one, has the head guard projecting upwardly alongside a sleeping surface of normal width (34 inches) in a position to protect the patient. The second position has the head guard swung horizontally on parallelogram linkages moving through about 180° toward the foot end of the bed to clear out the head end of the bed for the C-arm. With the guard out of the way, the C-arm, when moved into position, engages and pivots the longitudinal section of the head panel upwardly so that the C-arm can scan substantially the entire translucent panel at the center of the bed. The third position is similar to the first position. The head guard is raised to protect the patient. The parallelogram linkage, used to swing the head guard toward the foot end of the bed, is swung inwardly against the pivoting section of the head panel to swing it up out of the way and to permit the head panel to move into the space vacated by the longitudinal edge of the head panel. Comparable operations on the opposite side of the bed and at the foot end of the bed permit all guards to be moved about three inches inwardly, thereby narrowing the normal width of the bed by about six inches for the purpose of transporting a patient who is protected by the guards. The fourth, similar to the third position, has the head guard lowered and thrust inwardly under the bed to facilitate the transfer of a patient to the other bed.

The specific mounting of the head guard is another feature of the invention. The bed has an intermediate frame to which the head, seat, thigh and leg panels are mounted for articulating motion with respect to one another A parallelogram linkage which is mounted on vertical axes for horizontal swinging movement is pivotally mounted to the intermediate frame on each side of the head of the bed. The linkage has three positions. The first is the normal bed position holding the head guard alongside the patient. The second is the position swung down toward the foot end for opening up the bed for the C-arm. The third is the inward position, where it is latched, for narrowing the bed for transport or patient transfer.

The foot guard has a similar parallelogram linkage. The leg panel has similar swinging, upwardly-pivoted, longitudinal sections which are pivoted upwardly and inwardly by the inward swinging of the foot guards to narrow the foot end of the bed for transport or transfer of the patient.

It is important that the foot and head guards be reasonably close together to avoid a slot through which a very thin patient can slide. In accordance with the present invention, the head guard is adapted to be pivoted upwardly when the head panel is pivoted upwardly To eliminate interference with the close-by foot guard, the edge of the head guard adjacent the foot guard has a radius that has as its center the pivotal axis of the head panel so that when the head panel is raised, the head guard does not alter the gap between the head guard and the foot guard.

As a fourth feature of the bed, the four frames that are used to form the head panel, seat panel, thigh panel and leg panel of the bed are limited to a width dimension of about 23 inches. As indicated above, this dimension is too narrow for normal bed use. A patient support is therefore formed by wide, molded plastic panels, these panels being snapped into position on the narrow frames and thereafter covered with mattress.

The use of the narrow frame for the head panel is, of course, necessary in order to provide the removable sections which, in turn, permit the C-arm to have its beam moved farther across the translucent area of the bed. With the remaining panels, however, the reduction of width of the frame and the use of the plastic panels snapped onto the frames contributes to a very significant reduction in the overall weight of the bed.

BRIEF DESCRIPTION OF THE DRAWINGS

The several features and objectives of the invention will become more readily apparent from the following detailed description taken in conjunction with the accompanying drawings in which:

FIG. 11A is a side elevational view of the bed with guards positioned for patient transport;

FIG. 11B is a plan view of FIG. 11A;

FIG. 11C is an end elevational view taken along lines 11C—11C of 11A;

DETAILED DESCRIPTION OF THE INVENTION

Figure 1:
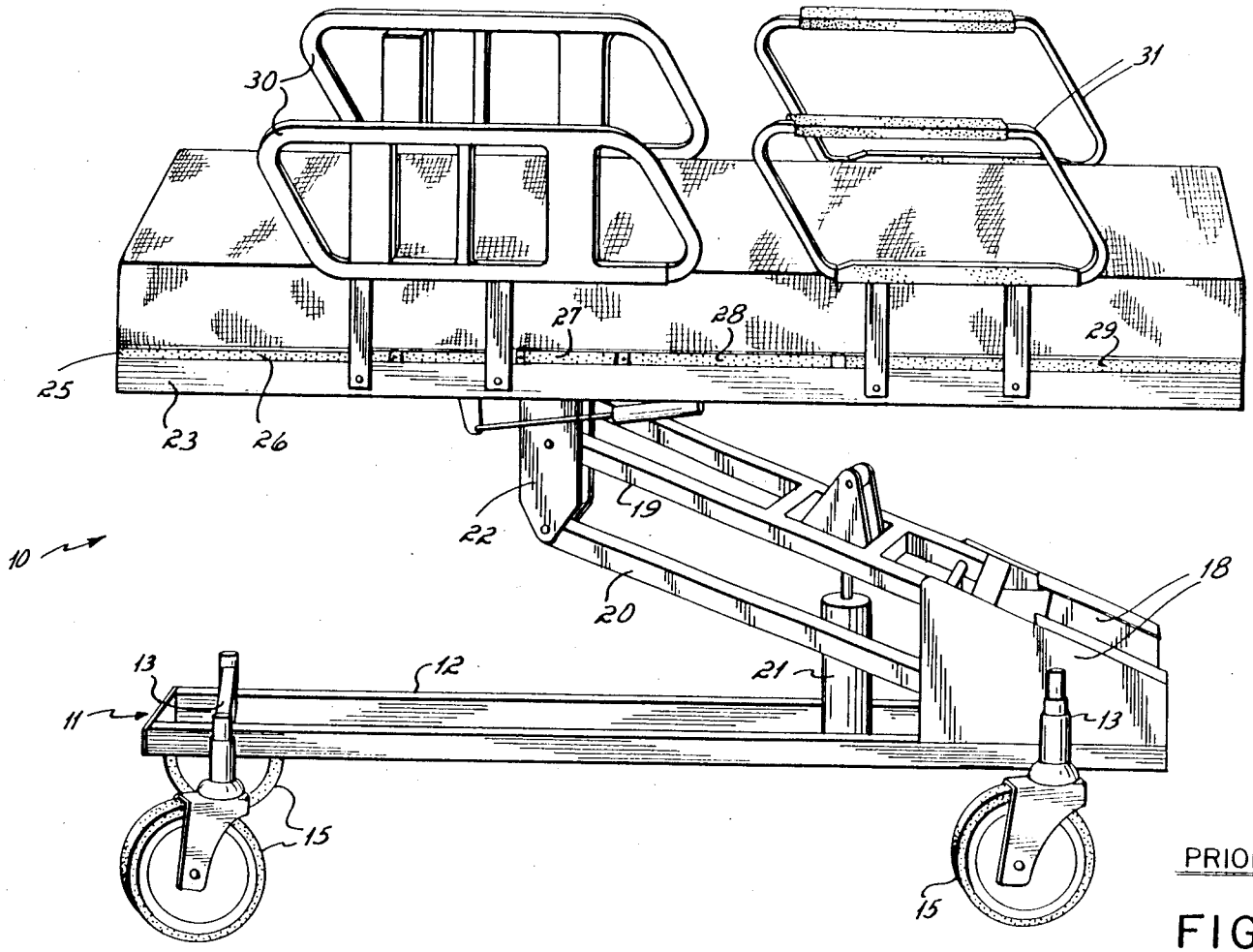
PRIOR ART FIG. 1
FIG. 1 is a perspective view of a prior art bed.
Figure 2:
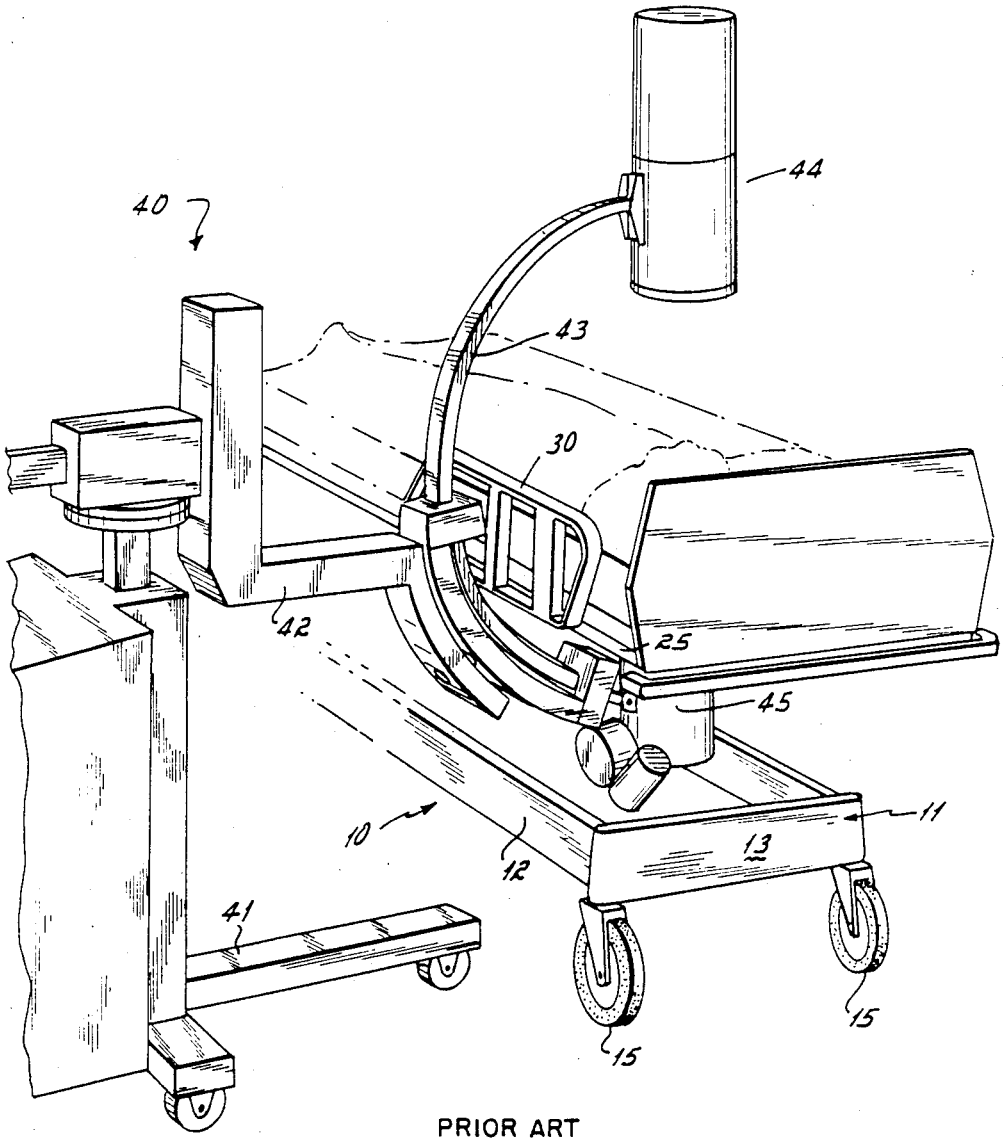
PRIOR ART FIG. 2
FIG. 2 is an in-use perspective view of a prior art bed.

Turning to FIG. 1, the known prior art bed is shown at 10. Its base 11 has a narrow backbone 12 mounted on transverse bars 13 at the head end and foot end, respectively. The bars carry casters 15 at their ends for the mobility of the bed.

A pair of parallel plates 18 are mounted on backbone 12. A cantilever arm 19 and a parallel stabilizing arm 20 are pivotally mounted to the plates 18. A depending bracket 22 supports a bed frame 23. The upper ends of the cantilever arm 19 and stabilizing arm 20 are pivotally connected to the bracket 22, thereby forming a parallelogram linkage to support the bed which can be raised and lowered by a hydraulic ram 21. The bed includes a patient support 25 having a head panel 26, a seat panel 27, a thigh panel 28 and a leg panel 29. Frames for these panels are hingedly connected to one another for shifting the patient's body position on the bed in a conventional manner.

Figure 3:
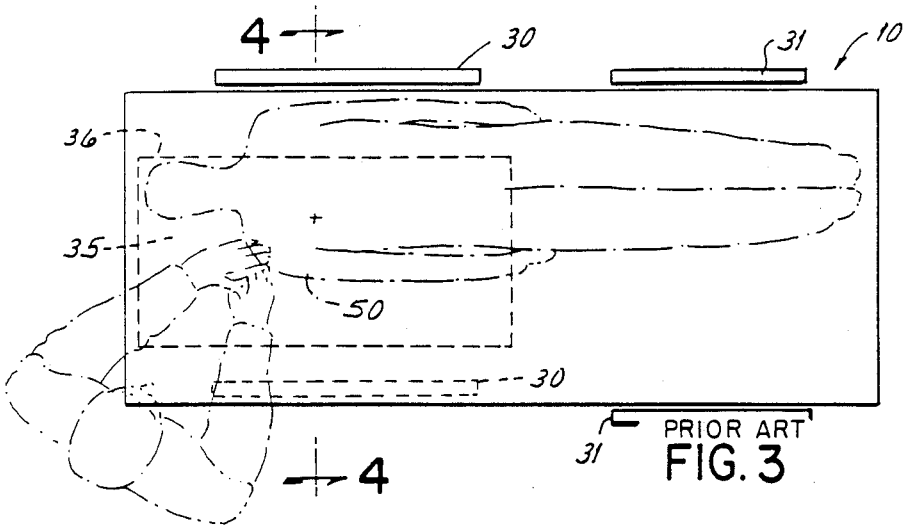
PRIOR ART FIG. 3
FIG. 3 is a diagrammatic plan view of a prior art bed.
Figure 4:
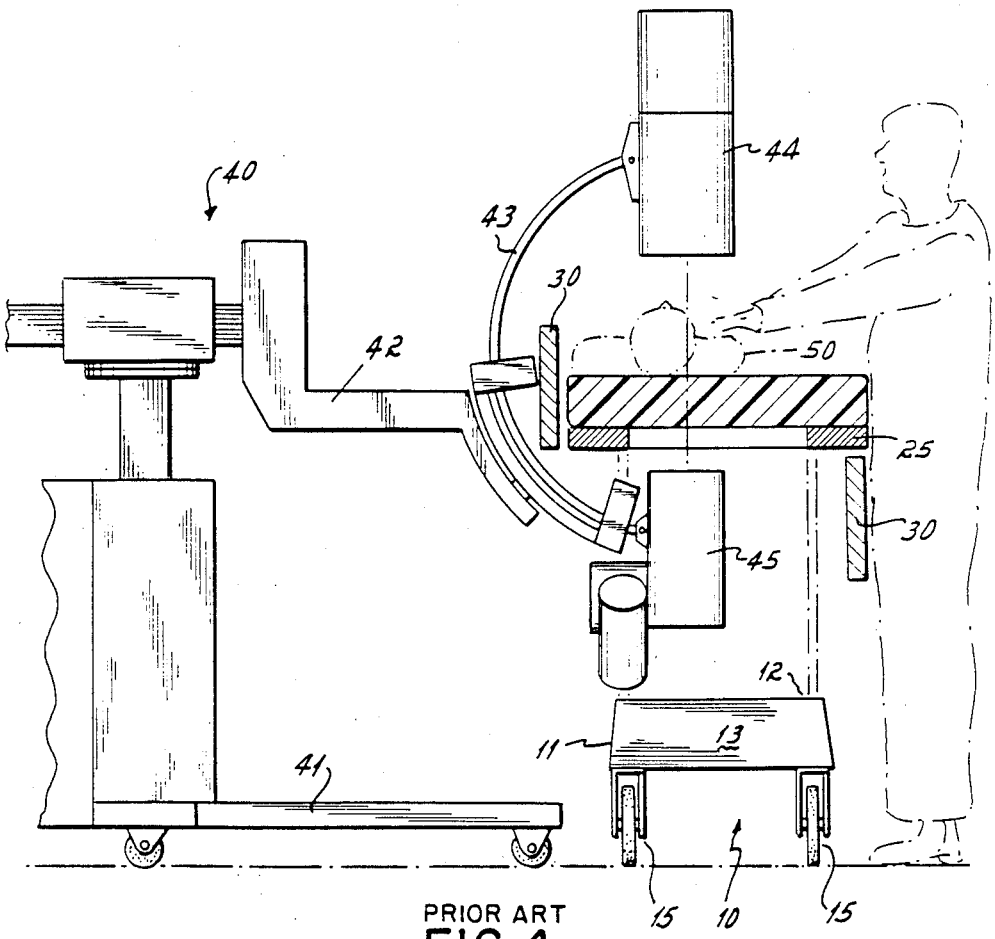
PRIOR ART FIG. 4
FIG. 4 is a diagrammatic end elevational view of a prior art bed.

As shown in FIGS. 3 and 4, the head panel 26 has a translucent area 35 delineated by the broken lines 36. Head guards 30 are mounted on each side of the head panel, and foot guards 31 are mounted alongside the thigh and leg panels.

A C-arm 40 is depicted in FIG. 4. The C-arm has a mobile base 41. A cantilever beam 42 is mounted on the base 41; a C-shaped support 43 is mounted on the cantilever arm 42. An X-ray unit 44 is mounted on the upper end of the C-arm 40 and a receiving image intensifier receiver 45 is mounted directly below the X-ray unit. A patient 50 lying on the patient support 25 is to be scanned by a beam 51 from the X-ray unit. Because of the shape of the C-arm and the conventional bed structure, including the head guards 30, the X-ray unit is blocked from moving to the center of the translucent area 35. It is therefore necessary in some circumstances to move the patient 50 under the beam 51 rather than moving the beam 51 to the patient. Note FIG. 4 depicting the patient on one side of the bed, under the X-ray, with the cardiologist on the far side of the bed reaching across it.

From FIG. 4, it can also be seen that the backbone 12 at the base of the bed presents an obstruction to the receiver 45 of the C-arm. In order to clear the backbone, the cantilever 42 must be raised upwardly and the bed must be raised accordingly in order to permit the receiver to pass underneath the bed and above the backbone All of this requires the bed to be raised to a level which is too high for the comfortable carrying out of the surgical procedures that are imaged by the C-arm and viewed on a monitor associated with the C-arm.

Figures 5, 6:
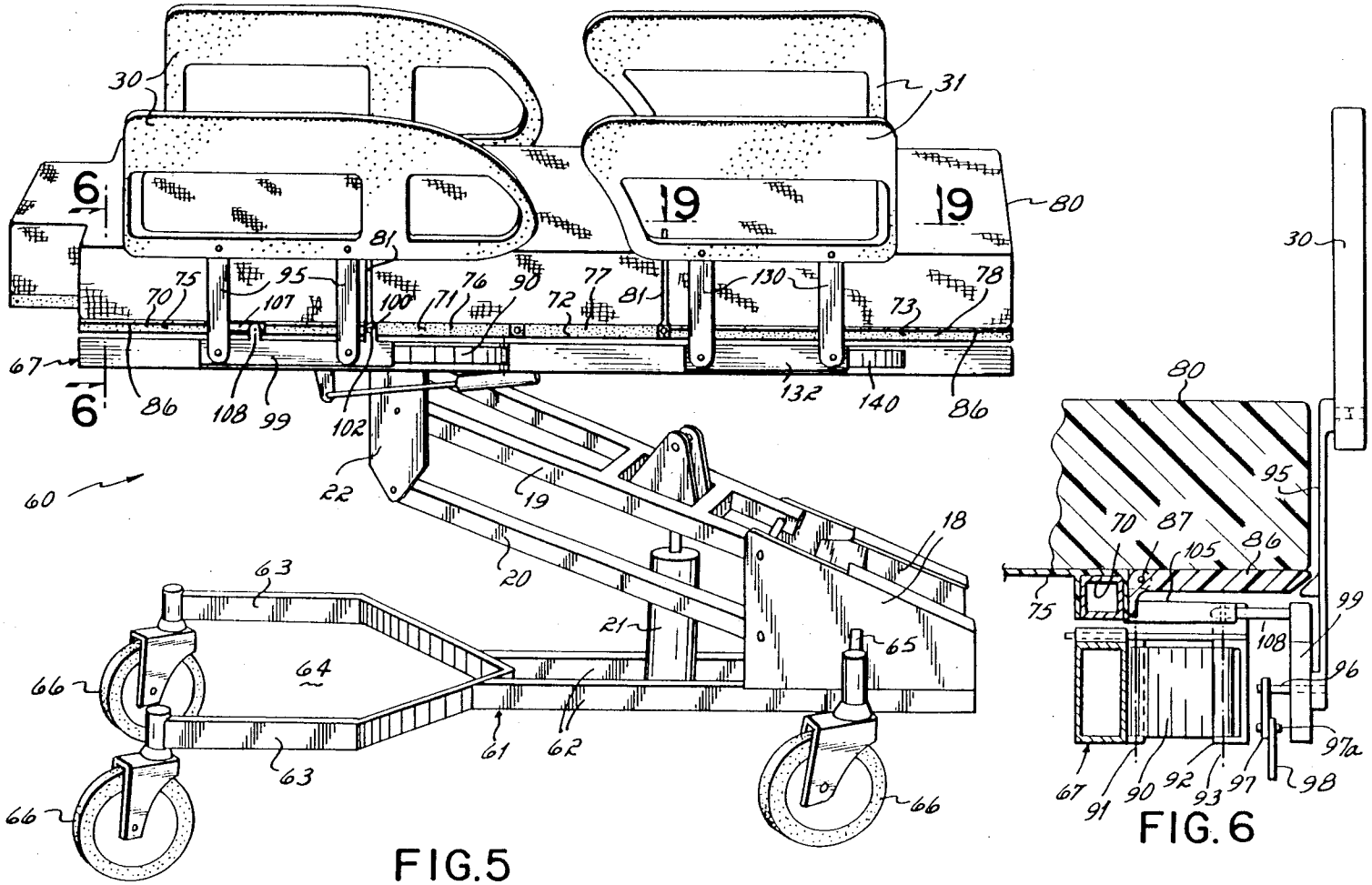
FIG. 5 is a perspective view of a bed of the present invention.
FIG. 6 is a cross-sectional view taken on line 6—6 of FIG. 5.

The bed 60 of the present invention, as depicted in FIG. 5, minimizes the problems of the prior art bed. The bed 60 has a base 61 which is Y-shaped having a stem 62 and branches 63 that open up area 64 immediately below the head end of the bed. The stem end of the base is supported on a crossbar 65 to which casters 66 are mounted. The casters 66 are also mounted on the ends of the branches 63.

Plates 18 are mounted on the base and carry the cantilever arm 19 and the stabilizing arm 20. The arms 19 and 20 are pivotally connected to bracket 22 to form the same parallelogram linkage as is found in the prior art bed. A hydraulic ram 21 is connected between the base and the cantilever arm 19 to raise and lower the bed. Mounted on the bracket 22 is an intermediate bed frame 67 which is about 23 inches wide. Four patient support frames, also about 23 inches wide, are mounted on the bed frame 67. They are the head frame 70, the seat frame 71, the thigh frame 72 and the leg frame 73. A translucent head panel 75 (FIG. 6) has a relatively planar upper surface and a lower surface configurated to snap over the head frame 70. The remaining frames 71, 72 and 73 are covered by similar panels 76, 77, 78 which are snapped or otherwise secured on the respective frames. Seat and thigh panels are about 34 inches wide, being the normal patient support width. Leg panel 73 is narrow, as is head panel 75.

Figure 12A:
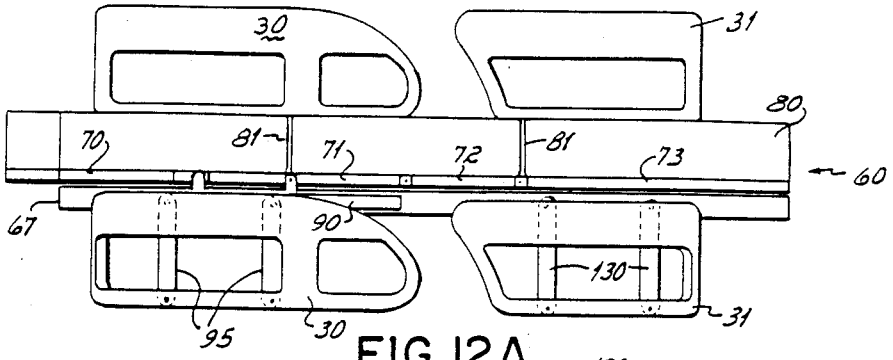
FIG. 12A is a side elevational view of the bed with head guards arranged for patient transfer from one bed to another.
Figure 12B:
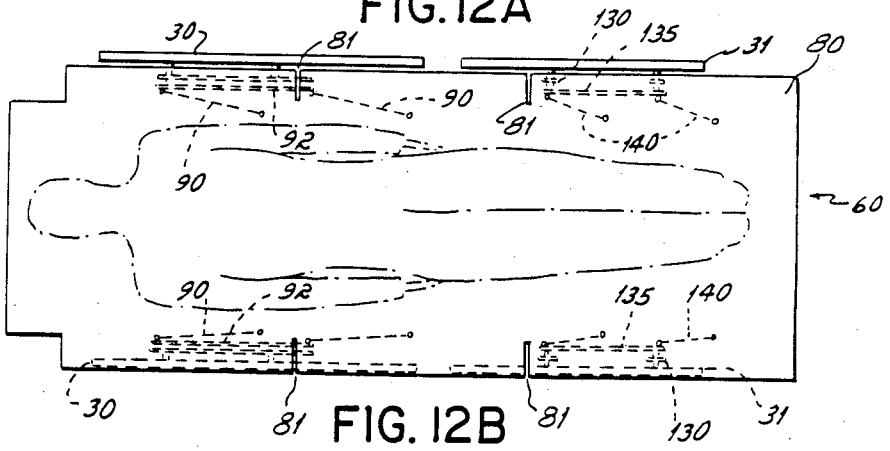
FIG. 12B is a plan view of FIG. 12A.
Figure 13:
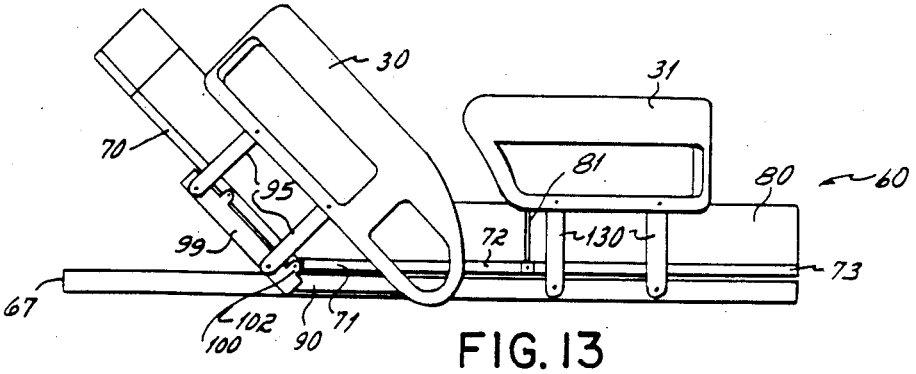
FIG. 13 is a fragmentary, side elevational view showing the head panel in raised position.

The panels are covered by a mattress pad 80 which is transversely slitted as at 81 (FIGS. 5, 12A and 12B) to permit the bed to be converted from a flat sleeping position to a sitting position as shown, for example, in FIG. 13, and so that the longitudinal sections can be pivoted upwardly to narrow the lateral dimension of the bed.

As seen in FIG. 6, the head panel 75 has, on each side, a longitudinal section 86 connected by a hinge 87 to the panel and covered by the mattress. The hinge is such as to permit the section 86 to extend in horizontal direction but to be pivoted upwardly, as shown in the left side of FIG. 10C, when engaged by a C-arm or when engaged by a head guard as shown in FIG. 11C. The section 86 is of sufficient width so that when swung upwardly through about axis 87, it narrows the bed for the C-arm.

Figure 7:
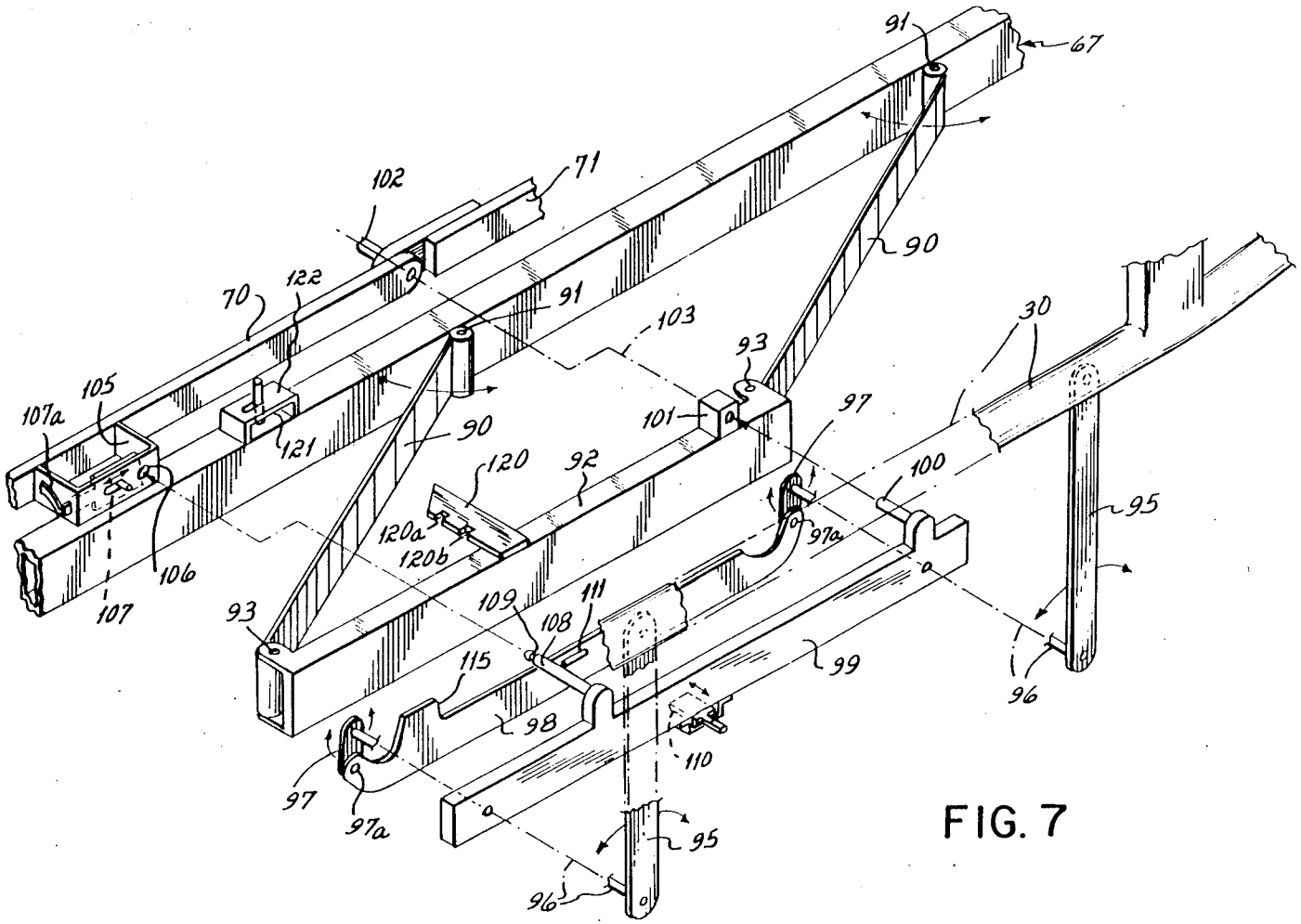
FIG. 7 is a partially disassembled perspective view of the head guard support mechanism.

Referring to FIG. 7, each head guard 30 is mounted on the intermediate frame 67. Two parallel links 90 are mounted on vertical axes 91 to the intermediate frame 67. A bar 92 mounted on vertical axes 93 to the links 90 completes the formation of a horizontally-swingable parallelogram linkage that carries the head guard 30. The head guard 30 is mounted on vertically-swingable links 95 that are fixed to horizontal pivot shafts 96 which are in turn fixed to links 97. The links 97 are pivoted at 97A to latch bar 98 that completes the formation of the parallelogram linkage which permits the head guard 30 to swing between the upper position of FIGS. 7 and 10A and to the lower position of FIG. 12A. An elongated plate 99 covers the latch bar 98 and is fixed to the bar 92. It has a pin 100 that passes through a boss 101 and, as indicated by broken line 103, is aligned with the pivot axis 102 of head frame 70 so that the head guard can pivot upwardly when the head frame 70 pivots upwardly to raise the patient to a sitting position (FIG. 13).

The head frame 70 carries a receptacle 105 having a hole 106 across which a keeper 107 is slidable. A latch pin 108 is fixed to the plate 99 and is adapted to be projected into the hole 106, which is somewhat larger in diameter than pin 108, The pin 108 has a notch 109. When the pin 108 is inserted in the hole 106, and the keeper 107 is urged against it by a leaf spring 107*a*, the keeper slides into the notch 109 and holds the pin 108 in the receptacle 105. In this condition, the assembly of plate 99 and latch bar 98 will swing upwardly with head frame 70 when head the head frame is swung up to bring the patient to a sitting position.

The pin 108 normally rests upon the upper surface of the bar 92. Thus, when the pin 108 is removed from the receptacle 105, the assembly of plate 99 and latch bar 98 remains held against the bar 92 by the pin 108 resting on the top surface of the bar 92.

Figure 8A:
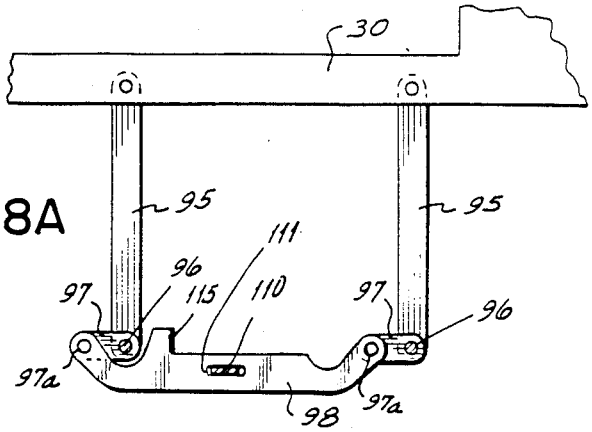
FIGS. 8A–8C are a series of operating positions of the mechanism of FIG. 7.

The head guard is capable of assuming three positions relative to the bar 92. In FIGS. 7 and 8A, it is shown in a raised, patient guarding position. It is held in that position by means of a latch bolt 110 that is slidable into a keeper slot 111. When captured, the latch bar 98 cannot move with respect to plate 99 and the head guard remains in elevated position. With the latch bolt 110 pulled out of the way, the latch bar 98 is released and links 95 can be swung to a downward attitude as shown in FIG. 8C. In this position, the parallelogram linkage 90 can be swung tightly against the intermediate frame 67 and latched there by a latch 120, to be described, thereby bringing the head guard under the mattress so that the bed can be brought closely against an X-ray table or another bed to which the patient is to be transferred. In this way, the gap between the two beds over which the patient must pass is minimized.

Figure 8B:
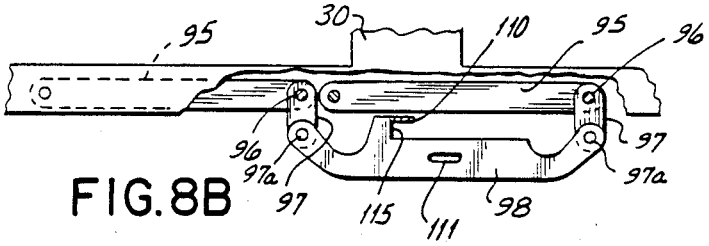
Figure 8C:
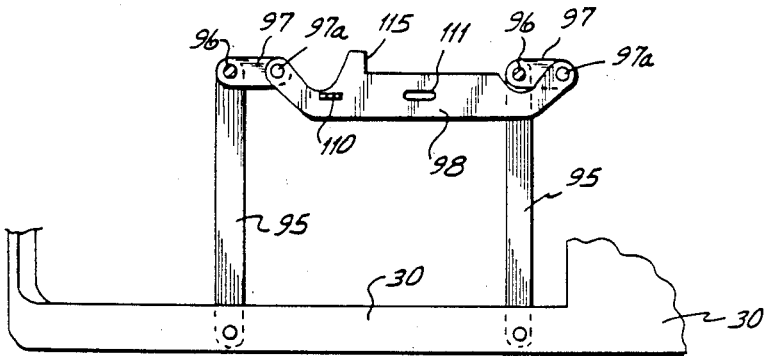

An intermediate position is available, as depicted in FIG. 8B. The head guard is swung toward the head end with the links 95 swinging through 90° to a horizontal position. The guard is held in that position by the engagement of the latch bolt 110 with the surface 115 of the bar 98.

The bar 92 carries a latch plate 120 which cooperates with a spring-loaded latch keeper element 121 in an inverted U-shaped bracket 122 on the intermediate frame 67. The latch plate 120 has two notches or slots **120*a* and 120*b*. When the latch plate 120 is partially inserted in the bracket 122 with the keeper element 121 in engagement with the slot 120*a*, the head guard is held in its normal bed position. When the latch plate 120 is inserted all the way into the bracket 122 with the keeper element 121 in engagement with the slot 120*b*, the bar 92 and head guard 30 are held in a laterally inward position. When the head guard 30 is in the raised and laterally-inward position as shown in FIGS. 11A to 11C, the head guard is in the transport position holding the hinge sections 86 in an upwardly-pivoted position to narrow the lateral dimension of the bed. When the head guard is in the lowered laterally-inward position of FIGS. 12A to C, the head guard is tucked underneath the bed in a patient transfer position that is best depicted in FIG. 12C. This latching engagement is required when the head guard is swung as closely as possible to the intermediate frame 67. That position is necessary when the head guard is raised for patient transportation on a narrow bed, see FIGS. 11A–11C. It is necessary when the guard is lowered, as shown in FIG. 12C**, to condition the bed for patient transfer from one bed to another.

Figure 9:
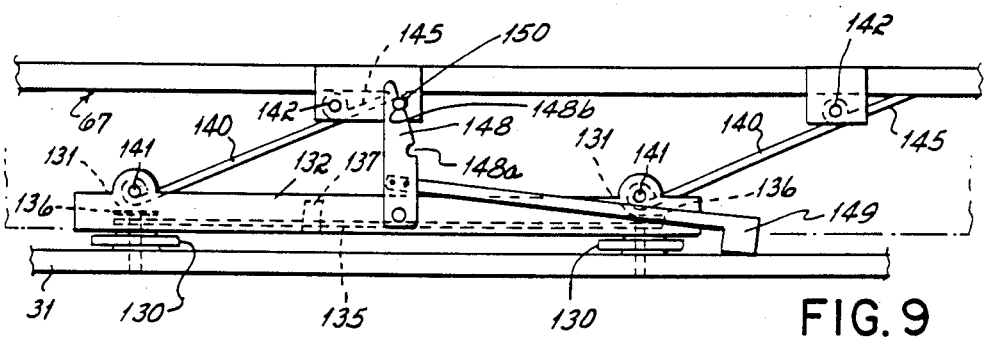
FIG. 9 is a top plan view of the foot guard support structure as seen generally along line 9—9 of FIG. 5.

A similar mounting is formed for the leg/foot guard 31 and is depicted in FIG. 9. The foot guard 31 is mounted on links 130 that are comparable to the links 95 that support the head guard 30. The lower ends of the links 130 are fixed to pins 131 which are pivotally mounted in a horizontal bar 132. The pins 131 carry a latch bar 135 comparable to the latch bar 98. The latch bar 135 is pivotally mounted at its ends to short links 136 comparable to the links 97 on the head guard. A latch and keeper 137 is connected between the latch bar 135 and the bar 132 to hold the foot guard in the raised position depicted in FIG. 13. The latch and keeper 137 are comparable to the latch bolt and slot 110, 111 of the head guard as depicted in FIG. 7.

The bar 132 is pivotally mounted to horizontal links 140 which have vertical pivot axes 141 and 142. Each link 140 has an inner extension 145 that will bear against the intermediate frame 167 when the links are swung to the farthest outboard position as depicted in FIG. 9. That is the normal position for the foot guard when the patient is in the bed. The bar 132 has a pivoted latch 148 having two notches **148*a* and 148*b*. The latch is spring-urged in a clockwise direction as viewed in FIG. 9. An operating lever 149 is connected to the latch. The latch 148 cooperates with a pin 150 to hold the bar 132 in one of two positions. The normal position shown in FIG. 9 is maintained by the notch 148*b* in engagement with the pin 150**.

An inboard position of the bar 132 is attained by the engagement of the notch **148*a* with the pin 150. In the inboard position, with the foot guard raised, the foot guard structure pushes against the hinged sections 86 at the foot of the bed, as depicted in FIGS. 11A to 11C**, to narrow the overall dimension of the bed for patient transport purposes.

Figure 12C:
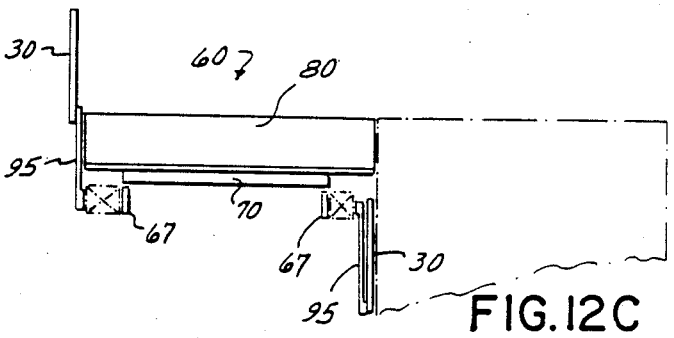
FIG. 12C is an end elevational view of FIG. 12A.

When the foot guard is swung to a lowered position as shown in FIGS. 12A to 12C and held inwardly by the engagement of the notch **148*a* with the pin 150, the foot guard is held under the bed, best shown in FIG. 12B**, so that the bed can be brought closely adjacent to another surface onto which the patient is to be transferred.

When the head guard is up to protect the patient, FIGS. 11A to 11C, and is swung inwardly and latched, the longitudinal sections of the head panel are pivoted up and in to narrow the bed by about three inches on each side from a width of 42 inches. With a similar positioning of the foot guards 31, the bed is narrowed to approximately 36 inches over its length to the extent that transporting of patients through doorways and the like is greatly facilitated.

Figure 14:
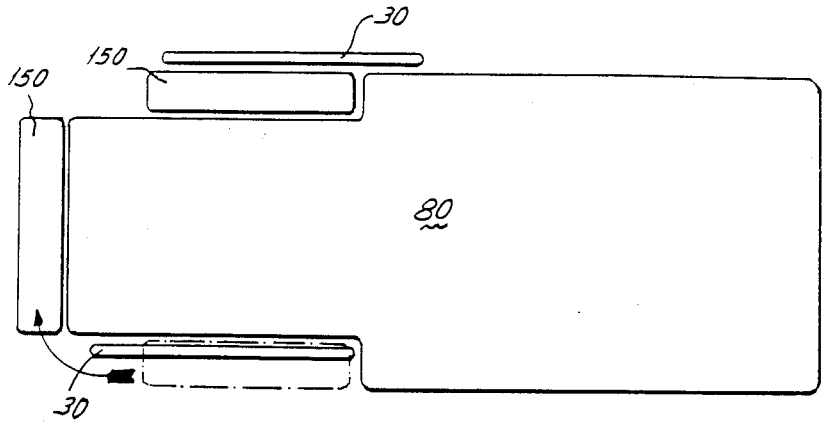
FIG. 14 is a diagrammatic plan view of an alternative embodiment.

While the invention has been described in relation to the pivoting longitudinal sections 86, as depicted in FIGS. 6 and 11C, it should be understood that longitudinal sections 150 could be made completely removable as seen in FIG. 14, instead of pivotably removable, so as to leave a space into which the head guard and support mechanism can be moved. The preference is to hinge the longitudinal sections to the main body of the sections alongside the foot guards so that the complete mattress and panel supports for the mattress always remain attached to the bed, thereby eliminating the possibility that they could be removed and become misplaced.

NORMAL BED OPERATION

The description of the operation of the bed will begin with the bed in the condition depicted in FIGS. 5 and 6 wherein the bed is in condition for primary patient support with the head and foot guards in their raised positions. The bar 92 supporting the head guard has been swung toward the head end of the bed. Preferably, the pin 108 is captured in the hole 106 (FIG. 7) so that if the head panel frame 70 is raised to bring the patient to a sitting position, the head guard will be pivoted upwardly with it as depicted in FIG. 13.

As can be seen in FIG. 5, the gap between the head guard 30 and foot guard 31 is narrow. The surface of the head guard 30 adjacent to the foot guard is curved on a radius having its center at the pivot axis 100 of the head guard so as to provide assurance that there would be no interference between the head guard and foot guard when the head guard is pivoted between the positions of FIG. 5 and FIG. 13.

C-ARM POSITION

Figure 10A:
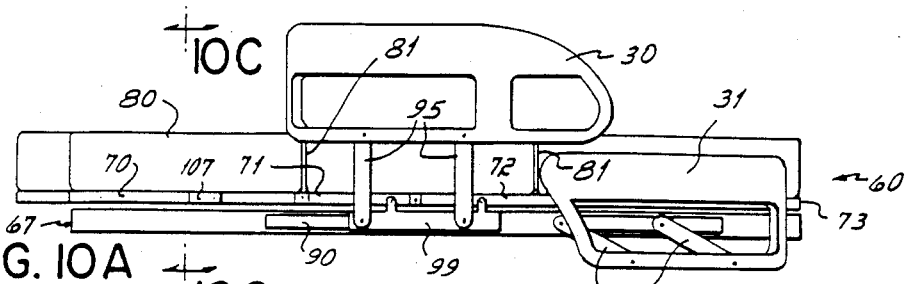
FIG. 10A is a diagrammatic side elevational view of the bed with the guards illustrated for patient operation.
Figure 10B:
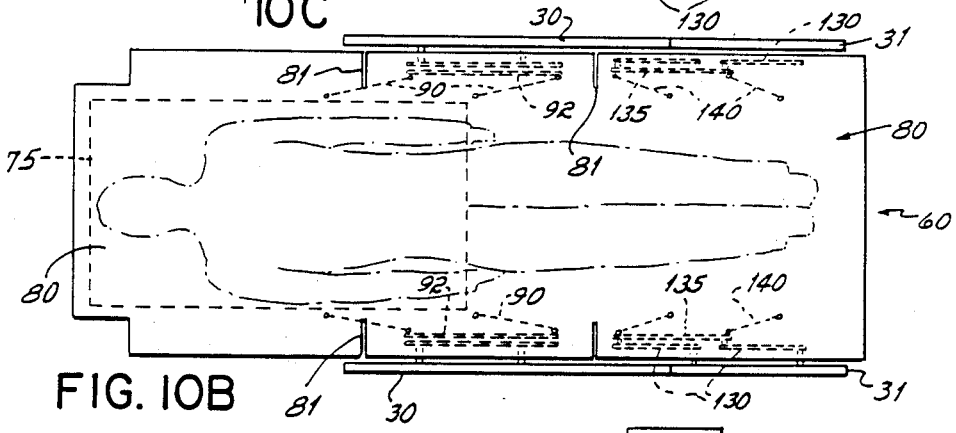
FIG. 10B is a diagrammatic plan view of the bed of FIG. 10A.
Figure 10C:
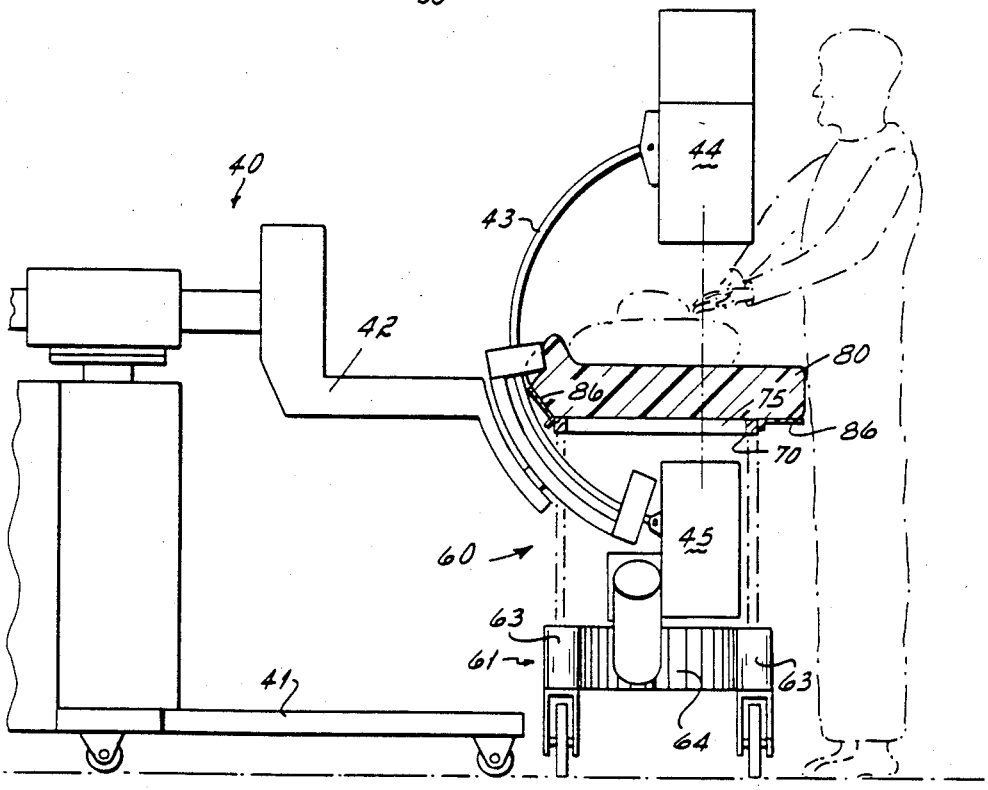
FIG. 10C is a cross-sectional view of the bed taken along lines 10C—10C of FIG. 1OA with the C-arm and radiologist illustrated.

When the patient is to be examined and treated using the C-Arm for imaging the patient's chest area, the bed elements are shifted to the position depicted in FIGS. 10A to 10C. Foot guard 31 is lowered. The head guard 30 is swung horizontally through approximately 180° to bring it to a position somewhat overlying the foot guard. By dropping the foot guard completely, the links 95 would permit the head guard to be swung even further toward the foot of the bed, thereby clearing out the area for the cardiologist.

The X-ray machine is brought into position with the receiver 45 being swung into the head end of the bed between the branches 63 of the base 61. (See FIG. 10C.) The C-arm structure physically engages the longitudinal section 86 of the head panel and swings it upwardly as shown in FIG. 10C. Thus, by getting the head guard out of the way of the C-arm, and by permitting the C-arm to move laterally inwardly by the upward pivoting of the longitudinal section 86 of the head panel, the center of the X-ray has been brought well past the center of the translucent panel 75 of the bed. Comparing FIG. 10C to FIG. 4 illustrates the significant improvement in the ability to scan the chest of the patient while the patient is relatively close to the cardiologist and without having to shift the patient laterally away from the cardiologist.

PATIENT TRANSPORT

In accordance with modern trends in patient care, the patient remains on the bed of his hospital room and is transported to other areas of the hospital, as needed, without the requirement of shifting the patient from the bed to a gurney. To facilitate the movement of the patient and bed, the bed should be as narrow as possible.

As shown in FIGS. 11A to 11C, the head guards and foot guards are in their raised positions to protect the patient. Each guard is swung inwardly, pushing against the hinged longitudinal section as best shown in FIG. 11C. That enables the guards to be brought inwardly about three inches on each side of the bed, thereby narrowing the bed by about six inches. The head guard is latched in that position by the cooperation of the latch plate 120 and keeper element 121. Similarly, the latch blade 148 and pin 150 of the foot guard as depicted in FIG. 9 hold the foot guard in the inwardly-latched position.

PATIENT TRANSFER

It is sometimes required to transfer the patient from the hospital bed to another support such as an X-ray table, an operating table or the like. As shown in FIGS. 12A to 12C, both head guards and foot guards can be swung to a low position as depicted in FIG. 12A. The guards are also swung under the patient support area, as shown in FIG. 12C, using the latching mechanism 120 and 121 for the head guard and 148 and 150 for the foot guard. As shown in FIG. 12C, permits the bed to be brought snugly against the surface to which the patient is to be transferred.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A hospital bed comprising:

a base, a bed frame mounted above said base, said bed frame having a translucent section at its head end, a head guard mounted on said bed frame alongside said translucent section of said bed, linkage means connecting said head guard to said frame to permit said head guard to be moved away from said translucent section, thereby permitting a C-arm to be moved against said bed frame adjacent said translucent section free from obstruction by the head guard, said linkage means comprising:

a parallelogram linkage including two spaced parallel links connected to said head guard and pivotal about vertical axes to permit said head guard to shift from a first position wherein said links extend toward the head of the bed through 180° to a position wherein said links extend toward the foot end of the bed.

2. A hospital bed comprising:

a base, a bed frame mounted above said base, said bed frame having a translucent section at its head end, a head guard mounted on said bed frame alongside said translucent section of said bed, linkage means connecting said head guard to said frame to permit said head guard to be moved away from said translucent section, thereby permitting a C-arm to be moved against said bed frame adjacent said translucent section free from obstruction by the head guard, said linkage means comprising both:

a parallelogram linkage including two spaced parallel links connected to said head guard and pivotal about vertical axes to permit said head guard to shift from a first position wherein said links extend toward the head of the bed through 180° to a position wherein said links extend toward the foot end of the bed, and a second parallelogram linkage pivotal about horizontal axes and connected to said first named parallelogram linkage to swing said head guard selectively upwardly and a farther distance toward said foot end and downward below the level of said bed frame.

3. A hospital bed comprising:

a base, a bed frame mounted above said base, a patient guard mounted on said bed frame alongside said bed, a horizontally-swingable parallelogram linkage connecting said patient guard to said frame to permit said guard to be moved laterally inwardly in only a horizontal plane to reduce the lateral dimensions of the bed while maintaining protection of the patient, means for latching said guard in said inward position.

4. A hospital bed comprising:

a base, an elongated bed frame mounted on said base and having a head end, a head guard, a pair of spaced parallel vertically-swingable links, each pivotally mounted at one end on said head guard, a pair of spaced parallel, only horizontally-swingable links, each pivotally mounted at one end on said bed frame, a bar pivotally mounted to the other ends of said horizontally-swingable links, selective latch means connecting the other ends of said vertically-swingable links to said bar for latching said guard in an upper position, a lower position and an intermediate position.

5. A hospital bed comprising:

b base, an elongated bed frame mounted on said base and having a head end, a head guard, a pair of spaced parallel vertically-swingable links, each pivotally mounted at one end on said head guard, a pair of spaced parallel, horizontally-swingable links, each pivotally mounted at one end on said bed frame, a bar pivotally mounted to the other ends of said horizontally-swingable links, selective latch means connecting the other ends of said vertically-swingable links to said bar for latching said guard in an upper position, a lower position and an intermediate position, said latch means comprising:

a latch bar and an elongated plate to which the other ends of said vertically-swingable links are pivotally mounted, means connecting said plate to said bar, and a latch bolt on said plate engageable with said latch bar to hold said bar and links in upper and intermediate positions.

6. A hospital bed comprising:

a base, an elongated bed frame mounted on said base and having a head end, a head guard, a pair of spaced parallel vertically-swingable links, each pivotally mounted at one end on said head guard, a pair of spaced parallel, horizontally-swingable links, each pivotally mounted at one end on said bed frame, a bar pivotally mounted to the other ends of said horizontally-swingable links, selective latch means connecting the other ends of said vertically-swingable links to said bar for latching said guard in an upper position, a lower position and an intermediate position, said bed frame having a head frame upwardly-pivoted about an axis, said latch means including an elongated plate pivotally mounted at its footward end on said bar on an axis aligned with said head frame axis when said guard is swung toward said head end, means for removably connecting said latch means to said head frame to pivot said guard about said axes when said head frame is pivoted upwardly.

7. A hospital bed comprising:

a base, an elongated bed frame mounted on said base and having a head end, a head guard, a pair of spaced parallel vertically-swingable links, each pivotally mounted at one end on said head guard, a pair of spaced parallel, horizontally-swingable links, each pivotally mounted at one end on said bed frame, a bar pivotally mounted to the other ends of said horizontally-swingable links, selective latch means connecting the other ends of said vertically-swingable links to said bar for latching said guard in an upper position, a lower position and an intermediate position, said bed frame having a head frame upwardly pivoted about an axis, said latch means including an elongated plate pivotally mounted at its footward end of said bar on an axis aligned with said head frame axis when said guard is swung toward said head end, means for removably connecting said latch means to said head frame to pivot said guard about said axes when said head frame is pivoted upwardly, said bed having a foot guard adjacent said head guard, said head guard having a surface adjacent said foot guard which is curved on a radius whose center is said latch means axis, whereby said head guard will not interfere with said foot guard when it is upwardly-pivoted.

8. A hospital bed comprising:

an elongated frame having a head end and a foot end, head guards mounted on said frame at the head end of said frame, mattress supporting panels mounted on said frame, longitudinal wings pivotally mounted on said panels and extending along the head end portion of said bed, said wings being pivotal independently of said head guards upwardly to reduce the lateral dimension of only the head end portion of said bed, means for moving either of said raised head guards transversely inwardly into the space vacated by said wings as said wings are pivoted upwardly.

9. A hospital bed as in claim 8 further comprising:

means for latching said head guard inwardly to hold said wings in an upwardly-pivoted position.

10. A hospital bed comprising:

an elongated frame having a head end and a foot end, head guards mounted on said frame at the head end of said frame, mattress supporting panels mounted on said frame, longitudinal wings pivotally mounted on said panels and extending along the head end portion of said bed, said wings being pivotal independently of said head guards upwardly to reduce the lateral dimension of only the head end portion of said bed, linkage means connecting said head guards to said bed frame to permit said head guards to be swung between an upper patient confining position and a lower position below said bed frame, means for moving said guards laterally inwardly when in either the upper or lower position to put the bed in condition for patient transport when in the upper position or patient transfer when in the lower position.

11. A hospital bed comprising:

an elongated frame, head guards mounted at the head end of said frame, mattress supporting panels mounted on said frame, means for removing a longitudinal section of said panel about 3 inches wide adjacent the head guard, means for moving the adjacent head guard horizontally into the space vacated by the longitudinal section of said panel.

12. A hospital bed having a head end and a foot end comprising:

a base, a bed frame mounted above said base, patient support panels, including a head panel, mounted on said base and having a lateral dimension of about 34 inches, said head panels including, on each side of the bed, an upwardly pivotable longitudinally-extending wing that narrows the bed when said wings are swung upwardly, a head guard normally mounted along each side of said head panel and projecting above said bed frame to protect a patient, means for moving said head guard toward the foot end of the bed, without lowering said head guard, whereby at least one wing can be pivoted upwardly to open up access to the bed while a head guard remains above said bed frame but shifted toward the foot end of the bed to keep the patient protected against falling out of bed.

* * * * *